US005166980A

United States Patent [19]

Burke, Jr.

[11] Patent Number: 5,166,980

[45] Date of Patent: Nov. 24, 1992

[54] TABULAR GUIDE DECRYPTING APPARATUS

[76] Inventor: Earl P. Burke, Jr., 2124 River Oaks Blvd., Houston, Tex. 77019

[21] Appl. No.: 723,056

[22] Filed: Jun. 28, 1991

[51] Int. Cl.[5] ..... H04K 1/00

[52] U.S. Cl. ..... 380/54

[58] Field of Search ..... 380/54; 283/17

[56] References Cited

U.S. PATENT DOCUMENTS

| | | | |
|---|---|---|---|
| 2,952,060 | 9/1960 | Avakian et al. | 380/54 |
| 3,227,474 | 1/1966 | Hoeflinger | 283/17 |
| 3,621,589 | 11/1971 | Jones et al. | 380/54 |
| 4,334,771 | 6/1982 | Ryan, Jr. | 380/54 |
| 4,512,581 | 4/1985 | Levine | 380/54 |
| 4,912,761 | 3/1990 | Tan et al. | 380/54 |
| 4,916,739 | 4/1990 | Iggulden et al. | 380/54 |

OTHER PUBLICATIONS

Tabular Programming Schedule published in TV Week of the Houston Post, published on or about Apr. 14, 1991.

*Primary Examiner*—Salvatore Cangialosi

*Attorney, Agent, or Firm*—Arnold, White & Durkee

[57] ABSTRACT

A decryption apparatus for use in correlating broadcast designations associated with tabular programming schedules to numerical channel designations corresponding to television channel selection apparatus. The decryption apparatus includes a plurality of generally transparent surfaces and a plurality of less transparent surfaces. The decryption apparatus may also include one or more generally opaque registration surfaces to facilitate alignment of the decryption apparatus with a tabular programming schedule to facilitate use thereof.

6 Claims, 4 Drawing Sheets

TABULAR GUIDE DECRYPTING APPARATUS

BACKGROUND OF THE INVENTION

The present invention relates generally to decryption devices for interpreting data presented in tabular form, and, more specifically, relates to apparatus for decrypting or correlating tabular schedules of television network programming relative to broadcast channels where such programming may be found relative to diverse sources such as cable-ready televisions, cable descrambler units, etc.

Many common sources exist which include television programming schedules represented in a tabular format. In typical tabular formats, one axis (for example, horizontal rows), will represent network programming, while the other axis (for example, vertical columns), will represent the various time periods. Thus, a multi-hour block of programming on numerous networks may be graphically represented in a relatively small space. Such tabular broadcast programming guides may be found in newspapers, both in many daily publications, as well as in weekly "T.V. Supplement" sections; and may be also found in independent commercially available guides.

Television programming, as may be provided through various cable companies, offers a large array of networks which may be selected for viewing. Television programming in many areas will include both a number of conventional broadcast stations and a number of networks whose signals are available only through the cable company. For example, it is not uncommon for cable companies in municipal areas to provide ten to fifteen broadcast stations, and twenty to thirty cable networks. In some areas, each of these numbers may be substantially greater. Accordingly, in various areas, a cable company may provide sources of thirty to fifty channels of television programming. Correspondingly, programming guides for such areas will typically identify programming for each of the channels available in the area.

The effects of a bewildering array of programming are compounded in other areas, for example, large metropolitan areas, where more than one cable company may participate in servicing customers in the metropolitan area. There is typically no uniformity between the channels upon which specific programs may be carried by the various cable companies servicing a given area. For example, while a first cable company may carry the programs of one network on channel 7 , another cable company servicing the same metropolitan area may carry that same network programming on channel 46.

As a result of these discrepancies, television programming guides typically identify cable networks only by their commonly known three letter call sign. For example, the call sign "ACC" is commonly used to identify a community access channel, etc. The difficulty exists that an individual wishing to tune to a specific network must then correlate, either through memorization of the plethora of network options or correlate through some separate reference, the desired network with its channel relative to a particular channel selection unit. The problem is further compounded by the fact that a cable signal communicated directly to a cable-ready television will often carry a given network on a first channel, while that same cable signal directed to a cable descrambler box will carry that same network on a second channel. Since it is not uncommon for both hookups to be found in a single home, the problems of memorization of channel locations become exacerbated.

Accordingly, the present invention provides a new apparatus for decryption of a tabular broadcast guide to facilitate ready and essentially simultaneous correlation between broadcast stations carried on a cable system and a particular channel selector system of interest.

SUMMARY OF THE INVENTION

The present invention provides a decryption apparatus which may be utilized to convert broadcast designators, such an non-numerical designators as found on common tabular programming schedules to numerical channel designators representative of appropriate numerical channels as utilized with a specific television channel selection apparatus.

The decryption apparatus in accordance with the present invention will include both relatively transparent or semi-transparent sections and either relatively less transparent or generally opaque sections. The relatively transparent sections will facilitate the viewing of a portion of a tabular programming schedule therethrough, while the less transparent section will facilitate placing the decryption apparatus in appropriate registry with a selected tabular programming schedule and will enhance ease of use.

The generally transparent section or surface will preferably be conformed relative to the generally less transparent or generally opaque sections in correspondence to a selected tabular programming schedule with which the decryption apparatus is to be utilized. The decryption apparatus includes a plurality of numerical channel designations which, when the decryption apparatus is placed in registry with the tabular programming schedule, will correspond to selected television networks.

In one particulary preferred embodiment, the decryption device includes a generally transparent or semi-transparent substrate of which selected portions are relatively occluded through application of a selected coating or coatings to the substrate. In such preferred embodiment, the numerical channel designations will be placed on the substrate or on the coating in the generally occluded or generally opaque sections.

DETAILED DESCRIPTION OF THE PREFERRED EMBODIMENTS

Figure 1:
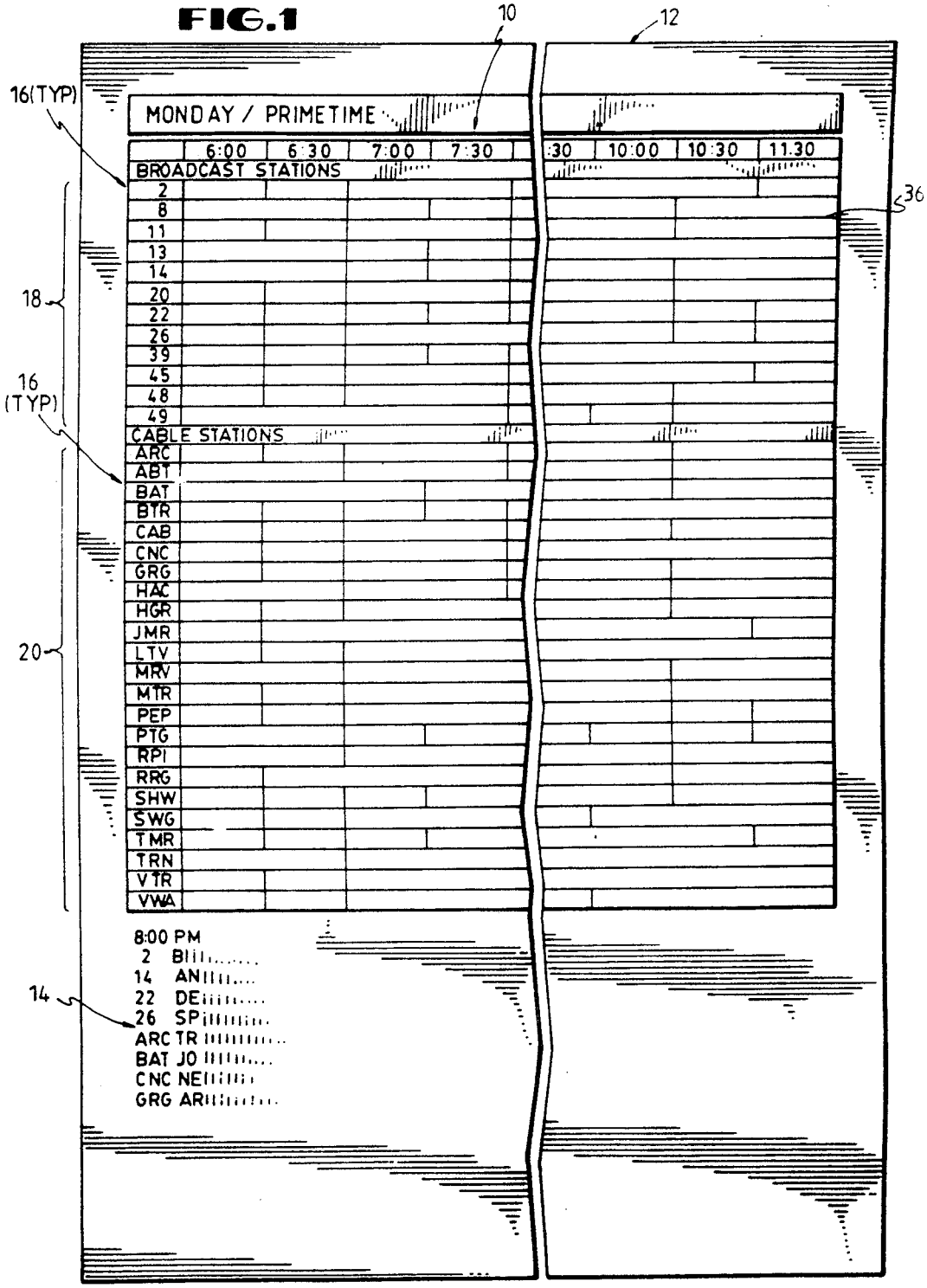
FIG. 1 schematically depicts an exemplary tabular programming schedule of a type with which the decryption apparatus of the present invention is particularly useful.

Referring now to the drawings in more detail, and particularly FIG. 1, therein is schematically depicted an exemplary page from a television broadcast guide including a tabular programming guide 10 of the type with which the decryption apparatus of the present invention is particularly useful. Tabular programming guide 10 is typically contained upon a single page 12 of a multi-page pamphlet or book, when located in a so-called "T.V. suplement." A tabular programming guide of this type may also be printed on a portion of a page in a daily newspaper. A programming guide page 12, will typically include not only tabular programming guide 10, but also a series of narrative listings 14 describing the individual programming selections identified on the tabular programming guide 10, but providing additional narrative explanation. As can be seen in FIG. 1, tabular programming guide 10 includes a plurality of horizontally arranged rows, indicated generally, and typically, at 16, and includes a plurality of vertical columns indicating broadcast times. In the exemplary guide depicted in FIG. 1, which is representative of one common format of guides, "broadcast stations," as represented in section 18, or those networks also available through airwaves, are designated with the channel designations by which they are available if received through the airwaves through a conventional antenna input into a tuner. Such "broadcast stations" may also be designated with their four letter designated call sign, or may be designated only by the four letter call sign. The fact that broadcast stations may be identified by a numerical channel indicator, does not necessarily indicate that cable companies in a given area will provide those networks on that same channel on the cable.

So-called "cable stations," or those stations available only through the cable supplier, as represented in section 20, are typically represented, as previously indicated, by a three letter call sign. As previously noted, the different cable networks may be found at different channel locations depending upon the cable company supplying the signals and the channel selection system utilized.

Figure 2:
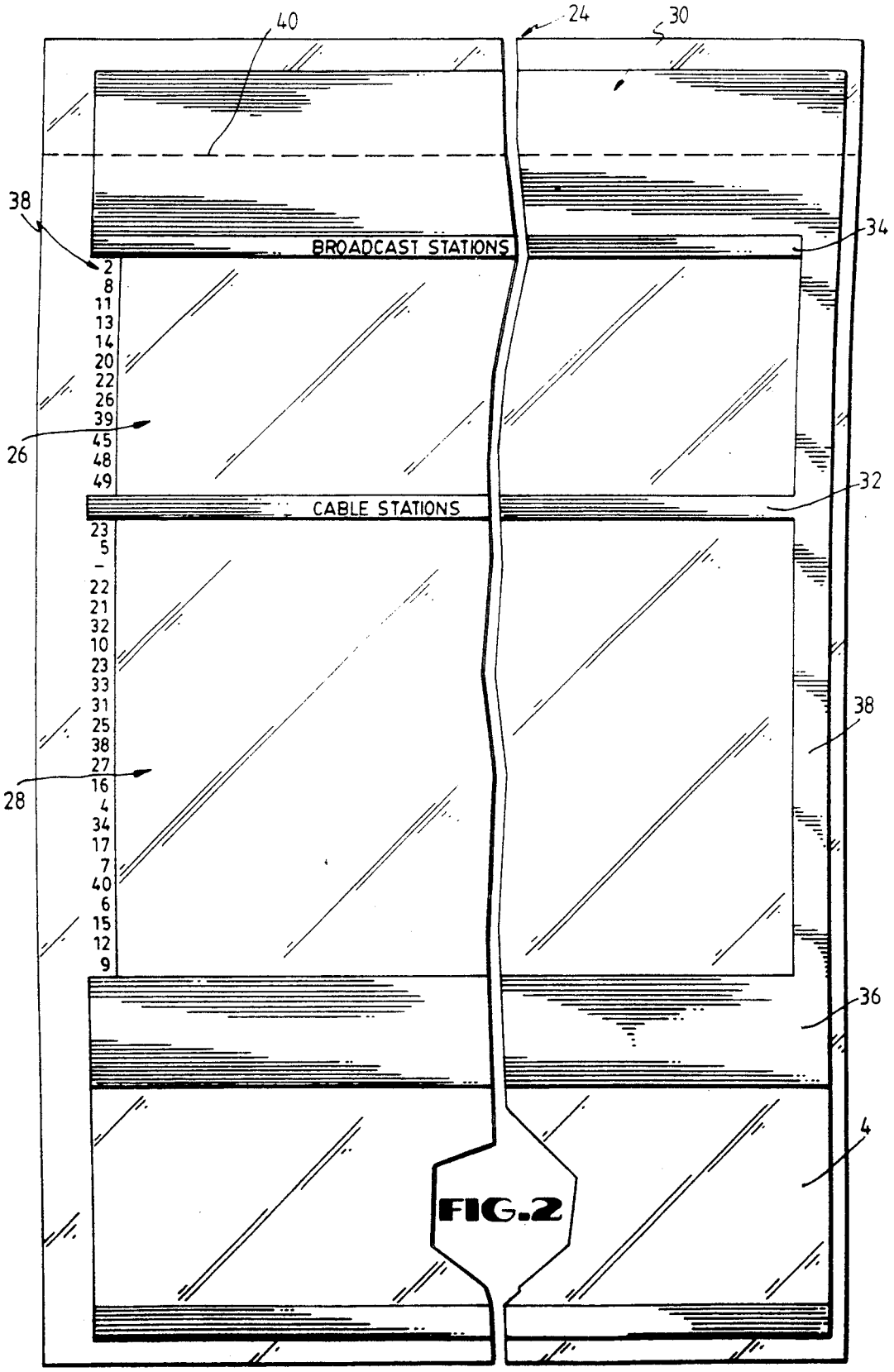
FIG. 2 depicts an exemplary decryption apparatus in accordance with the present invention.

Referring now to FIG. 2, therein is depicted an exemplary decryption apparatus 24 in accordance with the present invention. Decryption apparatus 24 includes a plurality of relatively transparent surfaces, as indicated at 26 and 28, and a plurality of either relatively less transparent or generally opaque surfaces, as indicated generally at 30, 32, 34, and 36. Decryption apparatus 24 may be formed of separate members, for example, generally transparent materials, such as conventional plastics and other generally less transparent, or generally opaque materials, such as various paper products or other plastics. Such materials would preferably each be generally planar members bonded or otherwise adhered together through conventional techniques.

In a preferred embodiment of the present invention, however, decryption apparatus 24 will be a single generally planar member forming a substrate. This substrate will be formed of a material having the characteristic of being substantially transparent. A coating will then be applied to this substrate generally planar member to render desired selected portions less transparent or generally opaque. In a preferred implementation, the substrate utilized will be a recyclable paper product. For example, a 100% wood fiber product marketed under the name Sihlclear Print, of 62 pound weight, available from Graphics Suisse of Chicago, Ill., has been found satisfactory. This paper product is not only flexible, and sufficiently transparent to facilitate ready viewing of a tabular programming schedule 10 through transparent portion 26 and 28, but also includes a surface characteristic of sufficient irregularity and roughness to facilitate use as an erasable notepad.

As can be seen in FIG. 2, decryption apparatus 24 includes a column 38 of numbers. The numbers in column 38 are representative of channel selector designations of use with a particular channel selecting device (as indicated previously herein, cable-ready television, cable descrambler device, etc.). The numbers in column 38 will be vertically spaced from one another to correlate with the rows 16 of a specific tabular programming guide 10, and such numbers will be arranged in such order as to represent the appropriate channel selection for a specific channel selection apparatus, in accordance with the order of networks as depicted on tabular programming guide 10.

Figure 3:
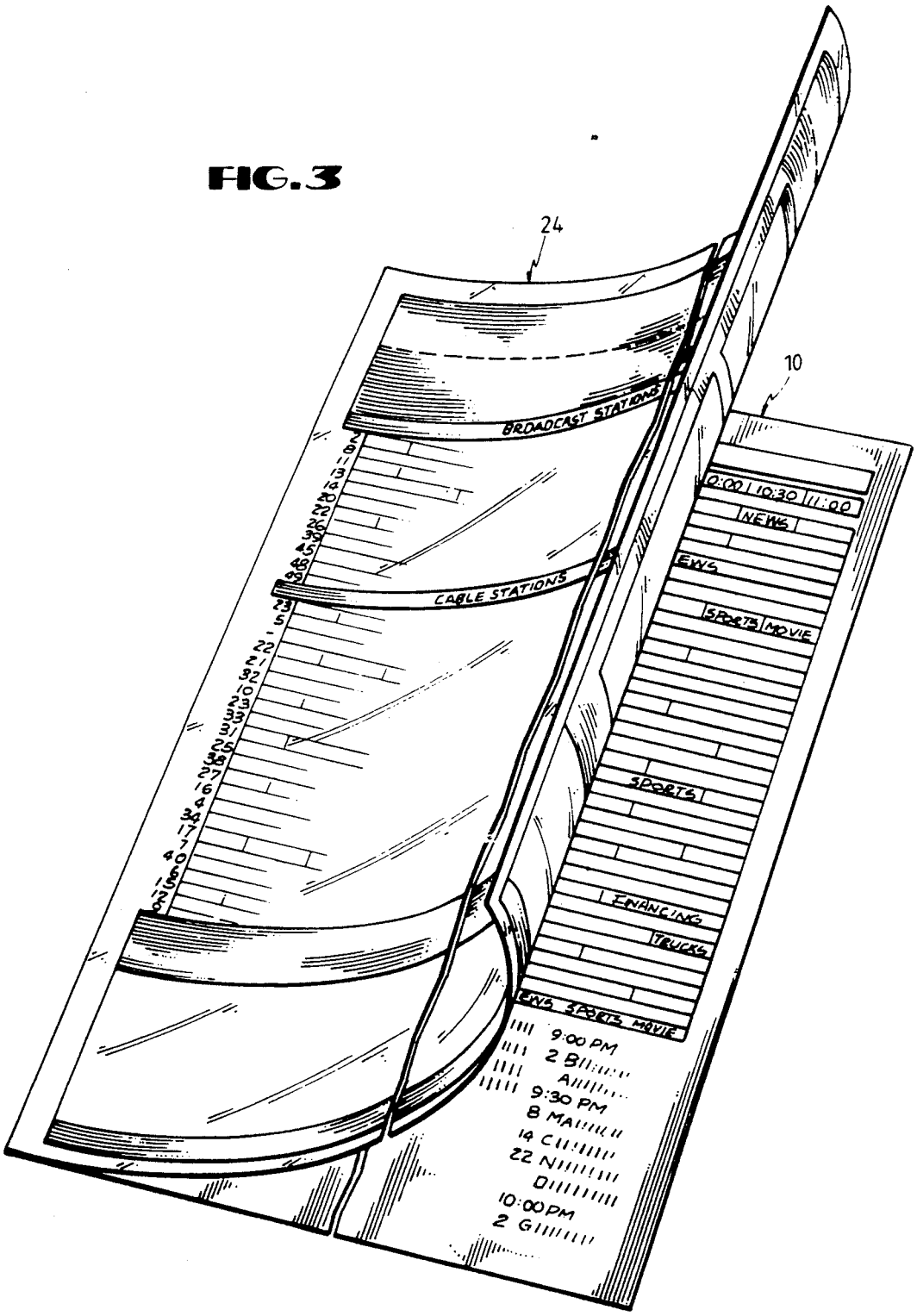
FIG. 3 depicts the decryption apparatus of FIG. 2 in process of being placed in an overlying operative relationship relative to the tabular programming schedule of FIG. 1.

Use of decryption apparatus 10 can best be viewed through reference to FIG. 3, wherein decryption apparatus 24 is depicted in process of being overlaid over tabular programming guide 10 to approach an operative relationship. The description of the structure and use of decryption apparatus 24 will be made with reference to each of the Figures. As can best be seen in FIG. 1, exemplary tabular programming guide 10 includes a pair of horizontal bands 36 and 38 which contain headings identifying the "broadcast stations" as distinguished from the "cable stations". As can be seen in FIG. 2, decryption apparatus 24 also will preferably include a pair of horizontal bands 32 and 34 which are equally spaced relative to the spacing of bands 36 and 38 of tabular programming guide 10. Thus, either one or both bands 32 and 34 may be used as a correlation guide when decryption apparatus 24 is overlaid with tabular programming guide 10 in the manner depicted in FIG. 3. When such correlation is achieved, the tabular program listings of tabular programming guide 10 may be viewed through transparent portions 26 and 28 of decryption apparatus 24. Additionally, the channel designations in column 38 with therefore automatically be displayed adjacent the rows 16 of each network's programming. Accordingly, a user of decryption apparatus 24 may view the overall programming represented in tabular programming guide 10 through decryption apparatus 24, and can, upon selection of a designated program, merely follow the horizontal row 16 to the selected margin (in the exemplary embodiment, the left margin) of the transparent area 26 or 28 to view the appropriate channel to be selected on the channel selection apparatus.

Where mediums are utilized which routinely displayed tabular programming guides for different time periods at a uniform placement on a page, provision may be made for providing a recess, such as by a fold at a specific location 40 so as to facilitate essentially immediate registration between locating bands 32 and 34 on decryption apparatus 24 and bands 36 and 38 on the tabular programming guides 10.

The boundaries of relatively opaque sections 30 and 36 (which may be considered to form a single quasi- or generally opaque perimeter), will preferably be selected so as to completely surround the parameter of the format of tabular programming guide 10 with whith the particular decryption apparatus 24 is intended for use. This structure serves to further improve registration between decryption apparatus 24 and tabular programming guide 10. Such structure also serves to provide optimal legibility by somewhat masking out irrelevant information. Additionally, opaque sections 30 and 36 may be imprinted or otherwise provided with data of relevance to consumers, such as emergency phone numbers, advertising, etc. The lower extent of decryption apparatus 24, beneath transparent sections 26 and 28 is primarily a matter of design choice. Decryption apparatus 24 may be of a structure as depicted in FIG. 2, wherein an additional transparent area 42 is provided proximate the lower portion of the generally planar member. Generally, transparent section 42 facilitates viewing of narrative programming guide listings with decryption apparatus 24 in registry with tabular programming guide 10.

Figure 4:
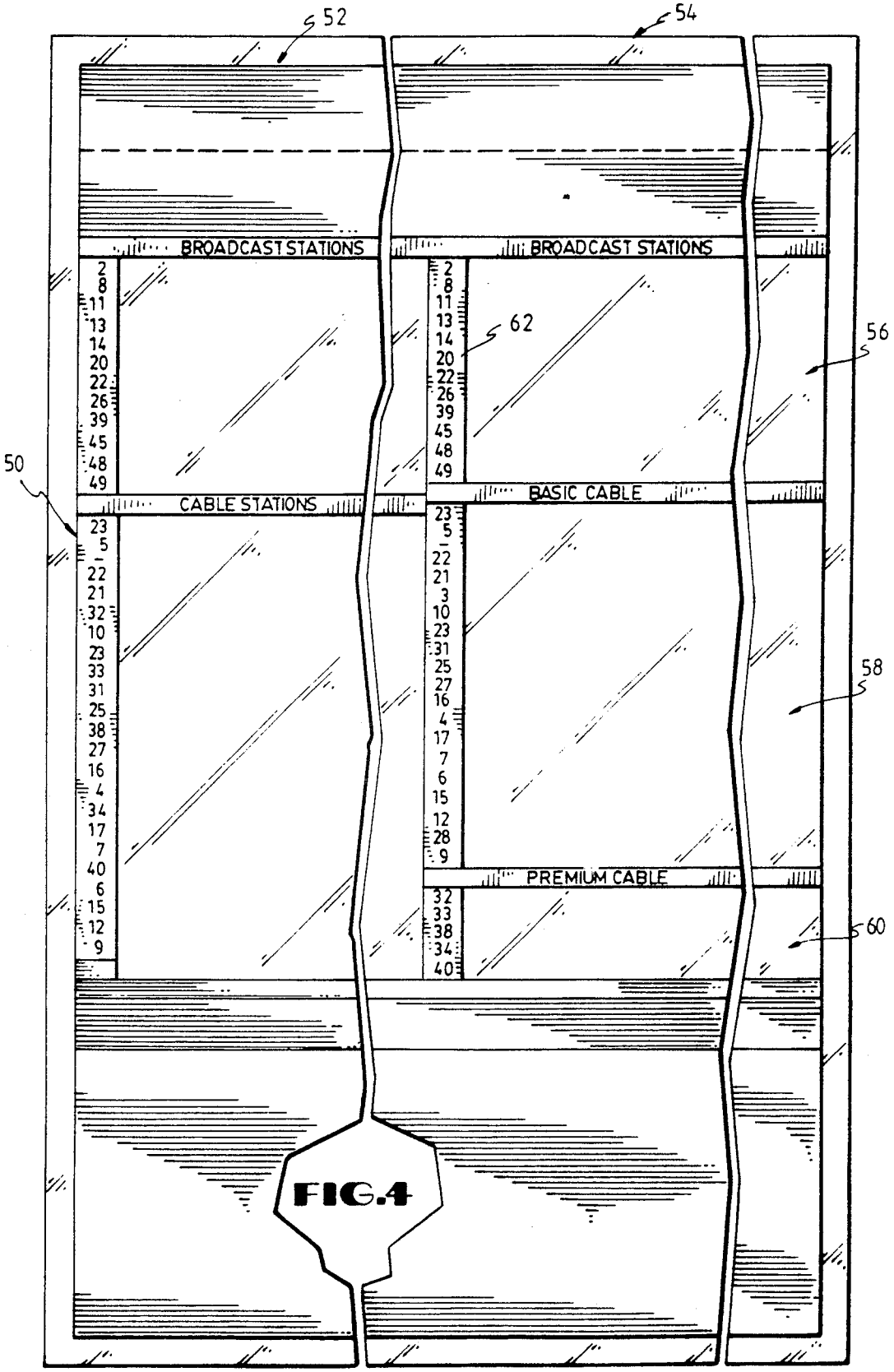
FIG. 4 depicts an alternative embodiment of a decryption apparatus in accordance with the present invention.

As noted earlier herein, tabular programming guides may be found in many sources. Depicted in FIG. 4 is a decryption apparatus 50 suitable for use with two different embodiments of tabular programming guides. Decryption apparatus 50 has a first side, indicated generally at 52, which is vertically configured essentially identically to decryption apparatus 24 of FIG. 2. Decryption apparatus 50, however, includes another side, indicated generally at 54 which is configured to correspond with a similar, but slightly different exemplary format for a tabular programming guide.

As can be seen in FIG. 4, side 54 includes three generally transparent sections 56, 58, and 60. A relatively less transparent bar 62 contains a second column 64 of channel designators. As will be readily appreciated, use of the decryption apparatus 50 is essentially identical to use of decryption apparatus 24, with the exception that decryption apparatus 50 will be overlaid such that either vertical column 38 or vertical column 62 is viewed relative to programming in question. As will be appreciated, these columns do not necessarily have to be overlaid to the left margin of a tabular programming guide, but may be placed at any position which allows adequate viewing of the selected programming of interest through the relative transparent sections, so long as decryption apparatus 50 is vertically aligned with the tabular programming guide in questions.

Many modifications and variations may be made in the techniques and structures described and illustrated herein without departing from the spirit and scope of the present invention. Accordingly, it should be readily understood that the techniques and structures described and illustrated herein are illustrative only and are not to be considered as limitations upon the scope of the present invention.

What is claimed is:

1. An apparatus for determining numerical television channel designations corresponding to a television channel selection apparatus, comprising:

a tabular program schedule having indicia along a first axis depicting broadcast channel designations and indicia along a second axis depicting times of broadcast; and a decryption member comprising, at least one generally transparent surface, said generally transparent surface of a size and shape to facilitate viewing of at least a portion of said tabular programming schedule therethrough; and a relatively less transparent surface adjacent said generally transparent surface, said relatively less transparent surface extending at least partially around said generally transparent surface and configured to generally isolate said tubular programming schedule when positioned over said tabular programming schedule, said relatively less transparent section including a plurality of numerical broadcast designators aligned generally adjacent said relatively transparent surface, said numerical broadcast designators being arranged in such an order such that when the decryption member is placed over said tabular programming schedule, the broadcast stations can be viewed through said relatively transparent surface adjacent to an appropriate corresponding numerical channel designation.

2. The apparatus of claim 1, wherein said apparatus includes at least one generally opaque registration surface, said registration surface sized and configured to correspond with a portion of said tabular programming schedule to facilitate placement of said decryption member relative to said tabular programming schedule.

3. The apparatus of claim 1, wherein said generally transparent surface is formed of a substrate, and wherein said relatively less transparent surface comprises a coating applied to said substrate.

4. The apparatus of claim 3, wherein said substrate is generally flexible.

5. The apparatus of claim 1, wherein said relatively less transparent surface is generally opaque.

6. The apparatus of claim 2, wherein said decryption member includes a plurality of generally opaque registration surfaces.

* * * * *